US010687687B2

(12) United States Patent
Doppelbauer et al.

(10) Patent No.: US 10,687,687 B2
(45) Date of Patent: Jun. 23, 2020

(54) DISHWASHER COMPRISING A SUCTION UNIT

(71) Applicant: BSH Hausgerate GmbH, Munich (DE)

(72) Inventors: Dominik Doppelbauer, Ederheim (DE); Markus Höpfl, Lauingen (DE)

(73) Assignee: BSH Hausgeräte GmbH, Munich (DE)

( * ) Notice: Subject to any disclaimer, the term of this patent is extended or adjusted under 35 U.S.C. 154(b) by 329 days.

(21) Appl. No.: 15/528,804

(22) PCT Filed: Nov. 30, 2015

(86) PCT No.: PCT/EP2015/078041

§ 371 (c)(1),
(2) Date: May 23, 2017

(87) PCT Pub. No.: WO2016/083615

PCT Pub. Date: Jun. 2, 2016

(65) Prior Publication Data

US 2017/0325654 A1 Nov. 16, 2017

(30) Foreign Application Priority Data

Nov. 28, 2014 (DE) ..... 10 2014 224 459

(51) Int. Cl.
*A47L 15/48* (2006.01)
*A47L 15/00* (2006.01)
*A47L 15/42* (2006.01)

(52) U.S. Cl.
CPC ..... *A47L 15/488* (2013.01); *A47L 15/0036* (2013.01); *A47L 15/4257* (2013.01);
(Continued)

(58) Field of Classification Search
CPC .. A47L 15/4257; A47L 15/483; A47L 15/486; A47L 15/488; A47L 15/0036;
(Continued)

(56) References Cited

U.S. PATENT DOCUMENTS 3,068,877 A 12/1962 Jacobs
4,064,888 A 12/1977 Diebel
(Continued)

FOREIGN PATENT DOCUMENTS

DE 4443849 A1 5/1996
DE 10058188 A1 5/2002
(Continued)

OTHER PUBLICATIONS

Machine Translation of DE 102006012217A1 to Stelzer et al., Oct. 2006. (Year: 2006).*
(Continued)

*Primary Examiner* — Benjamin L Osterhout
(74) *Attorney, Agent, or Firm* — Michael E. Tschupp; Andre Pallapies; Brandon G.. Braun

(57) ABSTRACT

A domestic dishwasher includes a wash container which has a loading opening. The loading opening of the wash container can be closed by a door. A suction apparatus is provided to suction steam and/or air, in particular moisture-laden air, escaping from the loading opening. The suction apparatus has at least one inlet window located outside a wet chamber of the wash container.

32 Claims, 4 Drawing Sheets

(52) U.S. Cl.
CPC ..... *A47L 15/483* (2013.01); *A47L 15/486* (2013.01); *A47L 15/4251* (2013.01); *A47L 2401/18* (2013.01); *A47L 2401/19* (2013.01); *A47L 2401/20* (2013.01); *A47L 2401/26* (2013.01); *A47L 2501/10* (2013.01); *A47L 2501/12* (2013.01)

(58) Field of Classification Search
CPC ..... A47L 15/4251; A47L 2401/19; A47L 2401/20; A47L 2401/26; A47L 2501/10; A47L 2501/12; A47L 2401/18
See application file for complete search history.

(56) References Cited

U.S. PATENT DOCUMENTS

| | | | | |
|---|---|---|---|---|
| 5,881,746 | A | 3/1999 | Buser et al. | |
| 7,798,157 | B2 | 9/2010 | Kim | |
| 9,181,647 | B2 | 11/2015 | Eglmeier et al. | |
| 2004/0261820 | A1* | 12/2004 | Monsrud | A47L 15/483 134/10 |
| 2006/0231122 | A1 | 10/2006 | Stelzer et al. | |
| 2006/0283482 | A1 | 12/2006 | Berends et al. | |
| 2007/0006898 | A1* | 1/2007 | Lee | A47L 15/0034 134/10 |
| 2007/0163098 | A1* | 7/2007 | Tomasi | D06F 58/203 28/100 |
| 2007/0251552 | A1 | 11/2007 | Lee | |
| 2008/0264458 | A1* | 10/2008 | Berner | A47L 15/483 134/57 D |
| 2009/0038661 | A1* | 2/2009 | Hildenbrand | A47L 15/483 134/56 D |
| 2010/0156259 | A1 | 6/2010 | May et al. | |
| 2013/0008474 | A1* | 1/2013 | Thayyullathil | A47L 15/488 134/95.2 |
| 2013/0180553 | A1* | 7/2013 | Gaus | A47L 15/483 134/105 |

FOREIGN PATENT DOCUMENTS

| | | | | |
|---|---|---|---|---|
| DE | 102006012217 | A1 * | 10/2006 | A47L 15/486 |
| DE | 102011003818 | A1 | 8/2012 | |

OTHER PUBLICATIONS

National Search Report CN 2015800637169 dated Oct. 23, 2018.
International Search report PCT/EP2015/078041 dated Jan. 20, 2016.
National Search Report DE 10 2014 224 459.5 dated Aug. 11, 2015.

* cited by examiner

DISHWASHER COMPRISING A SUCTION UNIT

CROSS-REFERENCES TO RELATED APPLICATIONS

This application is the U.S. National Stage of International Application No. PCT/EP2015/078041, filed Nov. 30, 2015, which designated the United States and has been published as International Publication No. WO 2016/083615 A1 and which claims the priority of German Patent Application, Serial No. 10 2014 224 459.5, filed Nov. 28, 2014, pursuant to 35 U.S.C. 119(a)-(d).

BACKGROUND OF THE INVENTION

The invention relates to a domestic dishwasher with a wash container, the loading opening of which can be closed by a door.

In some dishwashers, as for example those in DE 100 58 188 A1, DE 11 2005 000 920 B4, DE 10 2007 019 298 A1, hot air and/or hot steam can be discharged from the wash container by way of a drying blower to dry items being washed that have previously been cleaned with liquid in the respective wash cycle, said hot air and/or hot steam then being emitted to the exterior. As a result of the exiting, hot, moisture-laden air and/or the exiting, hot steam, the surroundings of the dishwasher are exposed to significant moisture, so that in particular furniture around the dishwasher can be damaged and the user can also be unpleasantly affected by rising steam and/or moisture-laden hot air. To prevent furniture damage, additional steam protection sheets or films are frequently fitted to the furniture. In particular a flat steam protection element is generally applied to the bottom of the kitchen countertop, below which the dishwasher is positioned, for example in a recess of a row of kitchen units.

BRIEF SUMMARY OF THE INVENTION

The invention addresses the problem of achieving an improvement in this respect.

According to the invention at least one suction apparatus or suction unit is provided to suction steam escaping from the loading opening and/or air that is in particular moisture-laden or carrying unpleasant odors. The suction apparatus suctions such a medium streaming out of the loading opening at least partially away from the region of the loading opening so that it is much less able to cause or does not result in any unwanted problems outside the loading opening, for example on kitchen furniture in proximity to the dishwasher, e.g. a kitchen countertop, below which the dishwasher is located, laterally adjacent furniture parts and/or for a user standing in front of the dishwasher. The suction apparatus is advantageously configured in such a manner that it traps the medium streaming out of the loading opening in each instance and transports it away from it to such a degree that unwanted problems due to the medium in the external surroundings of the dishwasher are largely avoided. It reduces or in particular prevents the respective medium streaming out of the loading opening rising further upward to a kitchen countertop and/or the head region of a user standing in front of the dishwasher in a manner that would cause problems. It is thus possible largely to avoid the condensing and precipitation of moisture on furniture in proximity to the dishwasher, in particular on the bottom of a kitchen countertop covering the top of the dishwasher.

Also a user standing in front of the dishwasher is better protected from rising, hot steam and/or rising, moisture-laden and/or odor-carrying air when the door opens.

A critical situation, in which the suction apparatus is advantageously activated, is present for example when a user pulls open the door during a wash sub-cycle of a dishwashing cycle, during which heated wash liquid is sprayed by means of one or several spray facilities in the inner chamber or treatment chamber, in other words the wet chamber, of the wash container and hot steam and/or moisture-laden, hot air, in particular plumes of steam or vapor, is/are present there. Without an activated suction apparatus this and/or these would escape precipitously and unimpeded upward from the door opening gap. A further critical situation, in which the suction apparatus is advantageously activated, is present in particular when, during the drying cycle of a dishwashing program at the end of the wash cycle, in particular in the second half of the predetermined drying time, preferably toward its end, the door of the dishwasher is opened to assist drying, to let air laden with residual moisture and/or steam residues out of the wash container in a specific manner. To this end it may be favorable to open the door in an automated manner, preferably by means of a door opening mechanism, to form a predetermined gap. In the event that for example soiled dishes have been kept in the wash container with the door closed, and there are odors in the treatment chamber of the wash container that are unpleasant to the human nose, the inventive extraction of the odor-carrying air by the suction apparatus or suction unit can also be advantageous as soon as the door is opened. Generally speaking the suction apparatus is advantageously switched on, in other words activated, when and for as long as there is an unwanted escape of a problem-causing medium, in particular steam, and/or moisture-laden and/or odor-carrying air, from the wash container to the external surroundings at the installation site of the dishwasher. This steam streaming out of the loading opening of the wash container and/or the air streaming out of the loading opening of the wash container is promptly trapped or sucked away at least partially by the suction apparatus, before it can stream so far out of the loading opening of the wash container that there may be unwanted problems in the surroundings, in particular for the furniture and/or for the user standing in front of the dishwasher.

According to an advantageous development of the invention the suction apparatus comprises one or several inlet windows which is/are preferably provided outside the wet chamber of the wash container, in particular in a front edge zone of the wash container that remains dry during the respective wash process in front of its loading opening, preferably in front of the door seal of the wash container delimiting the loading opening. This largely prevents liquid passing through the one or several inlet windows of the suction apparatus into its secondary components during the wash operation of the dishwasher and causing damage there, e.g. to the fan or suction blower of the suction apparatus. Specific sealing measures and complex sprayed water protection measures are not required for this advantageous variant of the suction apparatus. The one or several inlet windows can advantageously be configured as simple through openings, e.g. in the form of holes stamped in the edge region of the wash container that projects forward in relation to the door seal.

According to a further advantageous development of the invention it may be particularly expedient for the suction apparatus to have one or several inlet windows at least in the upper region of the wash container, in particular in its top wall, in some instances also in its left side wall and/or its right side wall, and for the one or several inlet windows only to be accessible from the inside of the wash container for steam and/or air escaping from the wet chamber of the wash container when the door is opened. This largely avoids complex reconstruction of the wash container. Also steam and/or air can be suctioned through the one or several inlet windows directly in the local region where said steam and/or air leave(s) the loading opening, before said steam and/or air can stream too far away from the loading opening of the wash container and reach the adjacent furniture or a user standing in front of the dishwasher in an impermissible manner.

It is particularly favorable for the suction apparatus to be switched on as the door opens or shortly before this. This allows hot steam that is exiting precipitously through the initial door opening gap and in particular rising upward and/or hot air that is exiting precipitously and in particular rising upward to be suctioned particularly efficiently, before it reaches surrounding furniture and/or the user standing in front of the dishwasher. It is advantageous in particular to operate the suction apparatus while the door opening gap is small, as hot steam that is exiting precipitously and in particular rising upward and/or hot air that is exiting precipitously and in particular rising upward is guided through the door opening gap in a relatively concentrated form, as through a chimney, and can therefore be efficiently held back before exiting from its upper end.

It is therefore particularly expedient for the suction apparatus to be switched on at the latest as soon as the door is opened, in particular by means of an automatic door opening mechanism, and moved from its closed position to an open position, in which an, in particular narrow, opening gap opens up between the door and the wash container. The suction apparatus is advantageously switched to suction mode from the start of door opening for a predeterminable time segment, in particular between 1 minute and 20 minutes duration, and then switched off.

It can be particularly favorable during this suction time segment for an initial time period, for example for the first minute from the start of door opening, for the suction blower of the suction apparatus to be operated at a higher rotation speed, in other words with a higher suction power associated therewith, than in the following remaining duration of the suction time segment. This allows the initially exiting, preferably upward rising hot steam and/or air rush to be conveyed particularly efficiently away from the loading opening in a direction which is different from the original outflow direction of the steam and/or air rush that is directed in particular at a steep angle upward through the door opening gap, in particular counter thereto.

The suction apparatus is expediently switched on while the door is in a position in which the opening gap has a depthwise extension or gap width of between 2 cm and 20 cm when viewed in the depthwise direction of the wash container. This is particularly advantageous if the inventive dishwasher is fitted with an automatic door opening mechanism which moves the door to a door opening park position with such a gap width.

Additionally or independently thereof the suction apparatus is then advantageously switched on when the door is moved from its, in particular roughly vertical, closed end position to an angled position tilted forward as park position with an opening angle of between 2° and 10°, preferably by means of an automatic door opening apparatus. In particular it can be advantageous if the door is opened first into a first opening intermediate park position with a door opening angle of between 2° and 3° to its closed position and the suction blower of the suction apparatus is operated at a higher rotation speed for between 30 seconds and around 1 minute. This allows steam and/or hot air, which wants to force its way out of the wet chamber or treatment chamber of the wash container upward into the external surroundings of the dishwasher through the narrow opening gap in the form of a spatially concentrated air stream, to be largely held back before leaving the upper region of the door opening gap formed between the upper edge of the door and the top wall of the wash container. The door is then preferably moved into a second door opening intermediate park position, in which it is at a door opening angle of between 5° and 10° to its closed position. During this operation the suction blower of the suction apparatus is operated at a reduced, in other words lower, rotation speed for between 10 minutes and 15 minutes.

According to a further advantageous development of the invention it may be particularly advantageous for a monitoring facility to switch the suction apparatus on when the temperature in the wet chamber of the wash container exceeds a predetermined threshold temperature, in particular around 40° C., beyond which steam is generated in the wet chamber of the wash container, and for the presence of a door opening or the start of the opening of the door to be detected.

The invention also resolves the problem mentioned in the introduction with a dishwasher with the features of claim 8 and a method with the features of claim 24. Further advantages and embodying features as well as developments of the invention are set out in claims 2 to 7, 9 to 21, 23, 25 to 27, the features of which can be brought into being individually or in combination with one another.

The invention relates to a domestic dishwasher with a wash container for cleaning dishes, glasses, flatware or similar items to be cleaned, the wash container being able to be closed by a door that can be displaced to open it, at least one intake or suction opening for air present in the wash container and a suction unit downstream of the intake opening being assigned to the wash container. Because with this inventive dishwasher as claimed in claim 8 the intake or suction opening leads into a chamber for condensing moisture in the air taken in, less moisture is emitted to the surroundings. A large part of the water contained in the air can condense in said chamber so that only a small quantity of residual moisture remains in said air after it has passed through said chamber. This preserves surrounding furniture, particularly in the case of built-in dishwashers, as water cannot condense on it or small quantities dry up very quickly. There is no longer a need for additional furniture protection.

If the at least one intake or suction opening is accessible when the door is open for steam and/or air exiting from the wet chamber of the wash container, the suctioning of said steam and/or moist air can take place while the door is opening, so that the steam and/or moisture from the appliance does not stream into the face of the user or strike the edge of furniture above, for example a countertop.

It is also possible for the at least one intake or suction opening only to be accessible for steam and/or air exiting from the wet chamber of the wash container when the door is open. This initially avoids contact between the wash container on the one hand and the condensing chamber on the other hand, so the chamber maintains a significant potential for moisture absorption and is not affected by moist, warm air from the wash container during operation, in particular in a drying phase, with steam suctioning only being allowed to start when the door is opening. In this process the door can be pushed automatically a small distance away from the dishwasher (in other words into a position angled steeply upward) so that the intake opening(s) is/are optimally accessible and the door can only be opened completely by the user after the steam has been suctioned and largely condensed. In any case when the door is open, the steam exiting upward at a steep angle through the door opening gap and/or the air exiting upward at a steep angle through the door opening gap is deflected by suctioning by means of the suction apparatus such that it is given a suction direction that is different from, in particular counter to, an outflow direction brought about by natural convection. In particular the exiting steam and/or air assumes a substantially horizontal or downward direction due to suctioning when the door is open, so that it can no longer rise upward and dampen surrounding furniture. The steam and/or air is/are deflected by way of the air gap formed when the door is open, forming a closed steam and/or air stream passing almost completely into the intake opening(s) due to the powerful blower.

In particular the suction unit can be switched on automatically by opening the door in the process or shortly before, thereby optimizing efficiency and minimizing an egress of steam from the opened door. This protects a kitchen worktop above the dishwasher in particular from moisture and possible mold formation.

If the chamber is configured in the manner of a duct, it can be incorporated in the dishwasher in a space-saving manner with a narrow width and depth of typically only a few centimeters but still a long length. This results in a large surface for interaction between the moist air and walls.

It may be expedient for the chamber in the dishwasher to be located outside the wash container. This does not restrict the volume of the wash container and parts that have to be mounted outside the dishwasher, such as deflector plates or the like, are not required.

If the condensation chamber is located in the door of the dishwasher, a hollow space that is present there anyway between what is referred to as the inner door and the outer door can be used to hold the duct. In particular an intake opening can then be extended into said chamber over a large part of the door width in its upper region. This widely extended slot-type opening with its intake draft would also reliably prevent the steam exiting upward in the direction of the furniture when the door was slightly open.

It may be expedient in particular for one or several inlet windows of the suction apparatus to be provided in the upper region of the inner wall of the door and to be arranged there in an edge zone outside the collection tray or trough in the door. When the door is closed, this edge zone with the one or several inlet windows is outside the loading opening of the wash container, which is delimited by the door seal mounted on the inside of the wash container in the region of the top wall and the two side walls of the wash container. It therefore remains largely dry during the respective wash process, during which wash liquid is circulated and distributed in the wet chamber or treatment chamber of the wash container. Wash liquid is therefore largely prevented from being sprayed into the one or several inlet openings arranged on the outer edge of the inner door. It is also advantageous for the chamber to tend to run downward from the intake opening to at least one outlet opening. The intake opening is therefore preferably higher than the outlet opening of the chamber of the suction unit. Condensed water can then run downward and back into the wash container there for example. Similarly the air containing less moisture can then exit in the lower region, either to the wash container or to the outside.

The chamber can be provided at its lower end with a collection region for liquid, which functions when the door is open, so that residual water only has to flow back when the door is next closed.

The intake opening can comprise a pattern of inlet windows, to allow an intake into the condensation chamber over a large region. For example the front frame of the wash container, which is preferably in front of the loading opening of the wash container (when viewed from the front) and in front of the door seal partially delimiting this on the outside, can preferably be provided with such inlet windows at the top and sides.

Optionally outer walls of the condensation chamber can also be cooled to allow to achieve a particularly high degree of water precipitation.

During operation of the inventive dishwasher the intake apparatus is expediently connected in such a manner that when the door is opened a little, for example at the end of a sub-program step for drying the items being washed, the steam exiting from the wash container in this process and/or the moisture-laden, hot air exiting in this process is suctioned by the suction unit by way of an air gap formed by the door opening.

As a result steam and/or moisture-laden air exiting initially in a steep upward direction from the door opening gap is thus given a preferably horizontal movement component and is thus guided to the intake opening. The steam and/or air can therefore no longer escape from the air gap to the outside unimpeded and dampen and condense on surrounding furniture, in particular a countertop above the dishwasher.

The exiting steam and/or air can be conducted in particular by way of an air gap of up to 20 centimeters between the wash container and an intake opening located opposite, in the opened door, mixing effectively with the drier outside air in the process.

If the dishwasher opens the door automatically at the end of the drying process, in particular after its completion (or even during the drying phase to assist drying), and switches the suction unit on as this happens or shortly beforehand, it ensures that a lot of steam and/or moist air can escape and the suction unit can still operate immediately at its full power when the door is open, so that steam and/or air is deflected from the rising direction to a different, in particular substantially horizontal or even counter flow direction, from the start.

Other developments of the invention are set out in the subclaims.

The advantageous configurations and developments of the invention described above and/or set out in the subclaims can be applied individually or in any combination with one another, except for example in the case of obvious dependencies or irreconcilable alternatives.

BRIEF DESCRIPTION OF THE DRAWINGS

The invention and its advantageous configurations and developments along with their advantages are described in more detail in the following with reference to schematic outlines in drawings illustrating exemplary embodiments, in which.

DETAILED DESCRIPTION OF EXEMPLARY EMBODIMENTS OF THE PRESENT INVENTION

Figure 1:
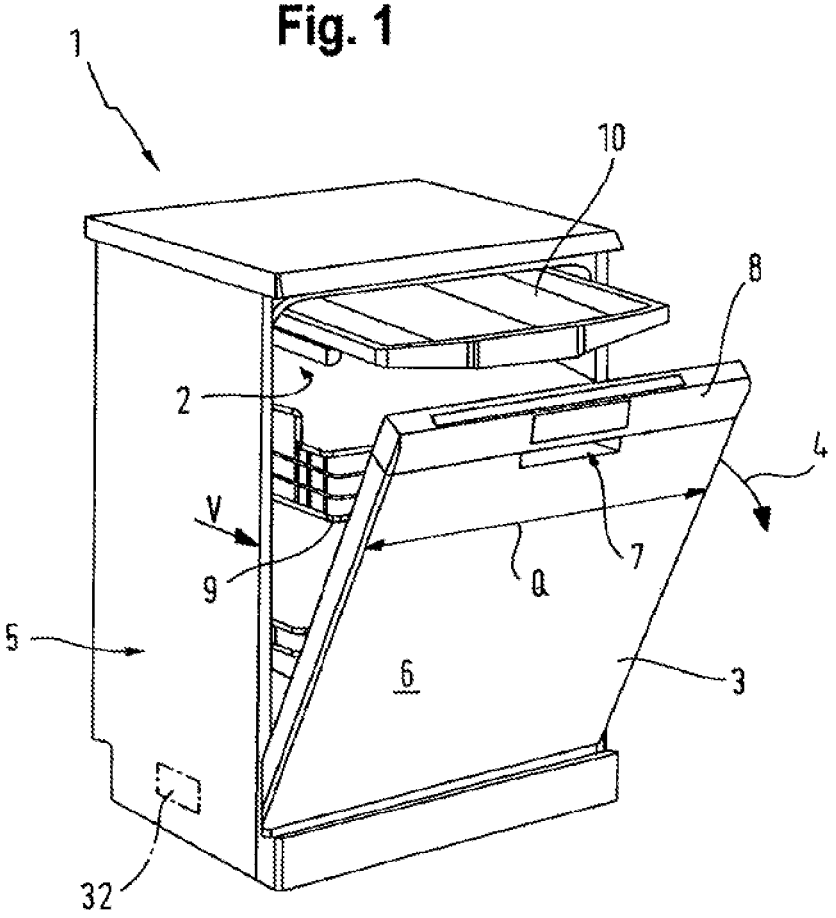
FIG. 1 shows an oblique perspective view from the front of a schematically illustrated dishwasher with the door partially open.

Elements of identical function and mode of operation are shown with the same reference characters in the figures.

The dishwasher 1 illustrated schematically in FIG. 1 is a domestic dishwasher and it is shown as a freestanding appliance only by way of example here. The invention is also of major significance in particular for appliances built into kitchen furniture.

The dishwasher illustrated here therefore has a carcass 5 which is closed on the outside but this is not mandatory. Provided in the carcass 5 is a wash container 2 for holding items to be processed by washing, such as dishes, pots, flatware, glasses, cooking utensils, etc. The items to be washed can be held for example in racks 11 and/or a flatware drawer 10, where they can be subjected to the action of wash liquor, in other words wash liquid such as fresh water or fresh water containing detergent or rinse aid. The wash container 2 can have an at least substantially rectangular footprint with a front face V, which faces a user in the operating position. The front face V here can form part of a kitchen front made up of adjacent kitchen furniture units or may not relate to other furniture in the case of a freestanding appliance.

The wash container 2 can be closed by a door 3 in particular at this front face V. Said door 3 is shown partially open and then at an angle to the vertical position in FIG. 1. It is upright in its closed position however and according to the drawing it can be pivoted forward and down in the direction of the arrow 4 about a lower horizontal axis to open it, so that it is almost horizontal in the fully opened position. An automatic intermediate position of the door 3 with just a small opening, for example during or at the end of a drying program step, is also possible.

The door 3 can be provided with a decorative panel 6 on its outer and front face V, which is roughly vertical and faces the user in its closed position, to improve visual and/or haptic properties and/or to match surrounding kitchen furniture.

The dishwasher 1 is configured as a freestanding or so-called semi-integrated or fully integrated appliance. In the last instances parts of the outer carcass 5 may not be required.

In the exemplary embodiment according to the drawing here the movable door 3 is assigned an operating panel 8, which extends in the transverse direction Q in its upper region, it being possible for said operating panel 8 preferably to comprise a grip opening 7 which is accessible from the front for opening and/or closing the door 3 manually.

The wash container 2 is also assigned at least one intake opening 12 (see FIG. 2-4) or 13 (see FIG. 5) of a suction apparatus 28 for air and/or steam present therein. In the diagram of the suction apparatus 28 according to FIG. 2 the intake opening 12 is located in the door 3 on its inner face facing the wash container in the closed position. The additional or alternative intake opening 13 of the suction apparatus 28, as illustrated in FIG. 5, comprises a plurality of individual inlet windows 14 and extends in the carcass 5 on lateral edges 15 assigned to the front face V and on an upper edge 16 of the wash container 2. Other arrangements are also possible. The respective intake opening can be continuous or broken. Several intake openings can also be provided at a distance from one another. To suction steam and/or hot, moist air, which rises upward through the door opening gap formed when the door is opened, it may be sufficient in particular for several inlet windows 14 to be provided only in the front edge of the top wall 33 of the wash container 2 and in some instances in the upper region of the front edge of the two side walls 34, 35 of the wash container 2.

At least one suction unit 17, 18, for example a fanwheel or blower, is also positioned downstream of the intake opening(s), as in the exemplary embodiments shown here. The suction unit 17 (FIG. 3) is located in the door 3 and can rotate about a horizontal axis. The suction unit 18 is preferably located on the carcass 5 above the wash container 2, in other words on its top wall 33, and can rotate for example about a vertical axis. Alternatively it can be positioned outside on one of the side walls 34, 35 of the wash container 2.

In any case the at least one intake opening 12, 13 transitions into a chamber 20, 21 for condensing moisture from the air and/or steam 22 taken in from the wash container 2.

Figure 2:
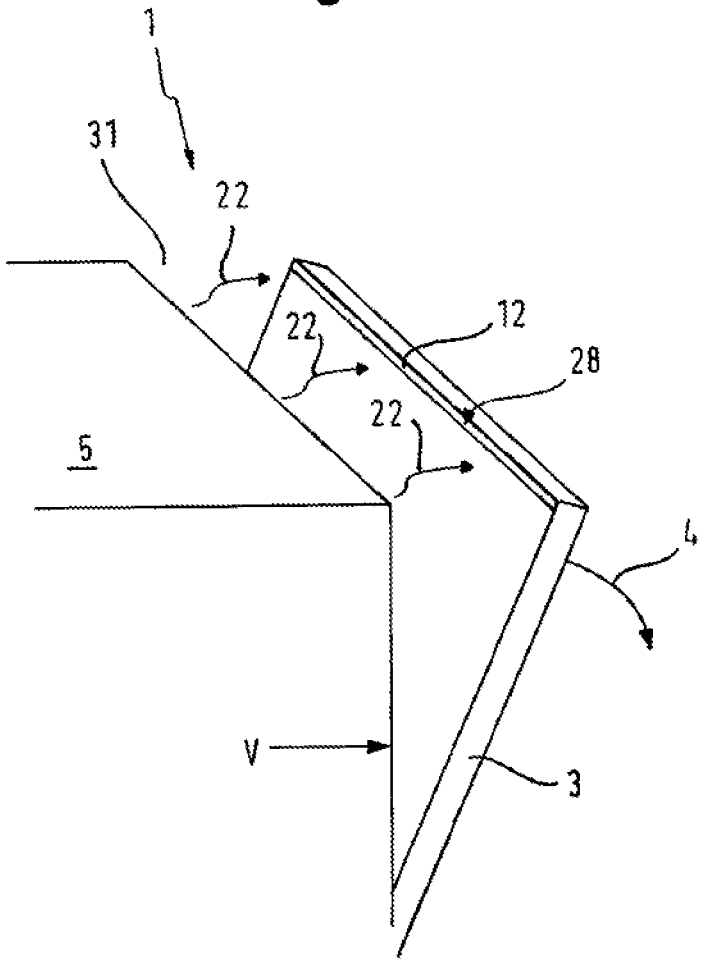
FIG. 2 shows an oblique view from the rear of the upper region of the appliance carcass and the door with the door slightly open and the intake unit switched on, FIG. 3 shows a schematic illustration of a condensation chamber and an intake opening with intake unit in the door, viewed from the front, the front surfaces of the door being omitted.
Figure 3:
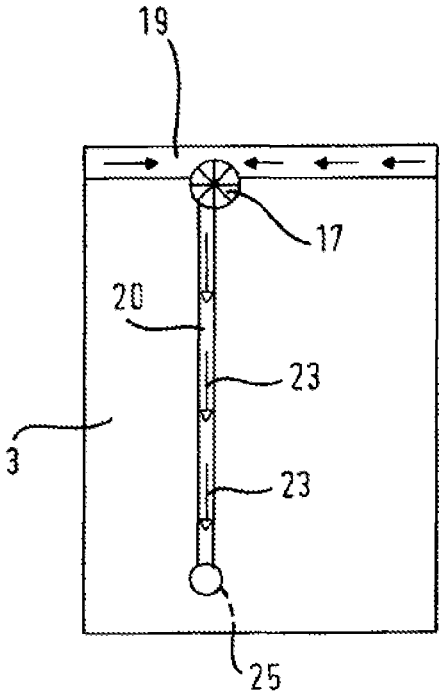
Figure 4:
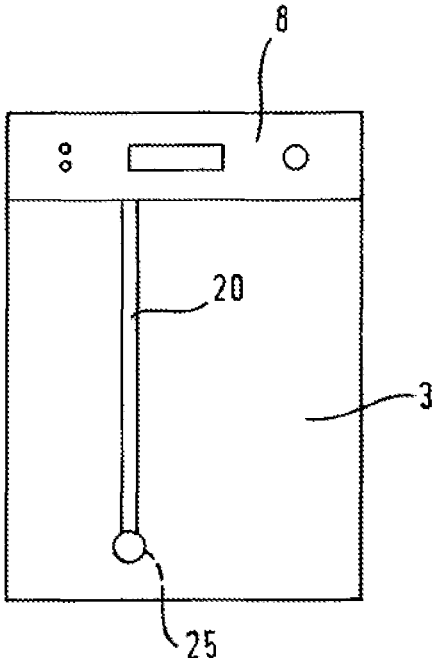
FIG. 4 shows a similar view to the one in FIG. 3 but with an operating panel shown in the upper region of the door.
Figure 5:
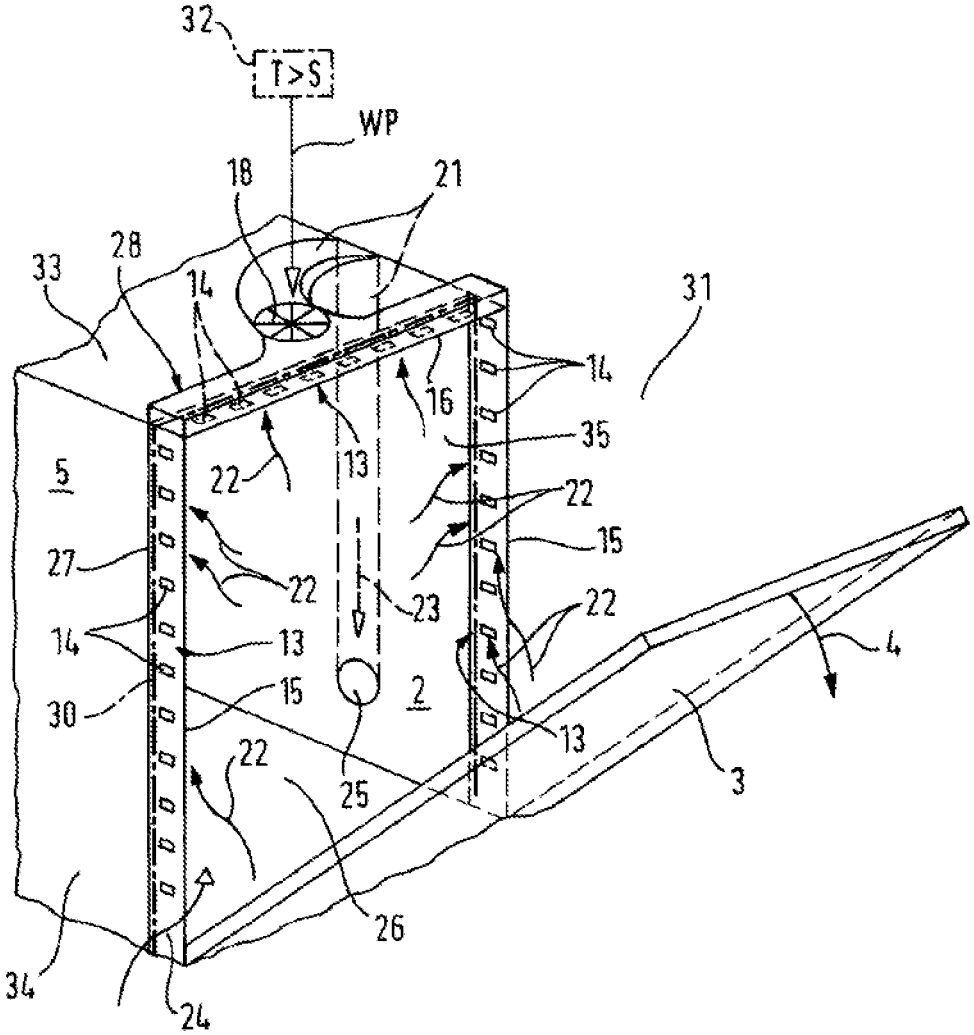
FIG. 5 shows an alternative configuration of a condensation chamber at the side of the wash container with inlet windows to the sides of and above the front edge of the wash container.

In the exemplary embodiment according to FIGS. 2 to 4 the chamber 20 of the suction apparatus 28 is configured in the manner of a duct and is located outside the wash container 2, specifically in the door 3, in a hollow space that is present anyway between what is referred to as the inner door and the outer door. The duct-like chamber 20 here only has an extension of several centimeters in the depthwise and widthwise directions (when viewed with the door in the vertical closed position) but several tens of centimeters, for example around 30 to 50 centimeters, in the heightwise direction, so that the drying air or steam 23 moving through the duct 20 covers a significant distance in which it can output water to the duct walls.

The intake opening 12 of the suction apparatus 28 in the exemplary embodiment in FIGS. 2-4, which supplies the chamber 20 with air, is located, as described above, on the inner face of the door 3 and extends in the manner of a slot-type opening running in the transverse direction Q over a large part of the door width in its upper region. In the diagram in FIG. 2 the intake opening 12 preferably extends over the full door width.

Behind the intake opening 12 in the door 3 is an air duct 19, which extends transversely and forms a component of the suction apparatus 28, in which air is moved to the intake unit 17 during the intake or suctioning operation. The air conveyed by the intake unit is then conveyed forward into the chamber 20, where it can largely condense. The duct-like chamber 20 runs down to at least one outlet opening 25. This can be aligned in the direction of the wash container 2, in this instance therefore toward the inner face of the door 3.

Also located in the lower region of the duct-like chamber 20 is a collection region for liquid, so that water that collects there runs back into the wash container 2 when the door 3 is closed.

The intake unit 17 is operated in such a manner that it is still switched on during the drying phase or for example at the end of a sub-program step for drying the items being washed to assist drying, when the door 3 is opened a little way, in particular automatically, and steam exiting from the wash container 2 in the process and/or moisture-laden air is suctioned by the suction unit 17 by way of an air gap formed by the door opening. Exiting steam and/or moisture-laden air is thereby preferably given a horizontal movement component and thus guided to the door-side intake opening 12. This is in particular very wide, for example around 40 centimeters in the case of a 45-centimeter wide machine 1 or around 55 centimeters in the case of a 60-centimeter wide machine 1. The steam is thus suctioned into the intake opening 12 by the intake unit 17 over its entire outlet width. The steam and/or moisture-laden air can therefore no longer escape unimpeded in the air gap, thereby dampening surrounding furniture, in particular a countertop above, and condensing there. The intake opening 12 can have a height of several centimeters, up to around 5 centimeters, for this purpose.

The exiting steam and/or the moisture-laden air can be conducted by way of an air gap of several centimeters (up to around 12 centimeters) when viewed in the depthwise direction of the dishwasher between the wash container and an intake opening 12 located opposite, in the door 3, mixing effectively with the drier outside air in the process.

In particular the intake unit 17, in particular an intake blower, is already switched on shortly before the door is opened. As soon as the door 3 opens in particular automatically, at which point or shortly before which the intake unit is switched on, it is ensured that a lot of steam and/or moisture-laden air can escape and the intake or suction unit 17 can still operate immediately at its full power when the door 3 is open, so that steam and/or air is deflected from the rising direction to a substantially horizontal direction from the start.

In addition to or independently of automatic door opening brought about by a door opening mechanism, the intake unit 17 can be activated in particular as soon as it is detected that door opening is present or has started. This is also the case for example when the user opens the door during a wash sub-cycle with heated wash liquid, e.g. the cleaning cycle or rinsing cycle. The intake unit, e.g. 17 or 18, is preferably connected to a monitoring facility 32 of the dishwasher, which activates the intake unit by means of a control signal by way of a control line or signal line (not shown) on receipt of a signal representing door opening. The monitoring facility 32 is additionally shown with a dot-dash line in FIGS. 1 and 5. In FIG. 5 the monitoring, in particular the switching on and off, of the intake unit 18 by the monitoring facility 32 is shown schematically by an arrow WP.

In the exemplary embodiment according to FIG. 5 the chamber 21, which belongs to the suction apparatus 28, is also configured generally in the manner of a duct and is located outside the wash container 2, specifically with a first, horizontal segment above the wash container 2 outside on its top wall 33 and with a continuing, vertical segment to the side of a vertical wall, in particular in this instance the side wall 35 of the wash container 2. Here too the vertical segment of the duct-like chamber 21 only has an extension of several centimeters in the depthwise and widthwise directions but several tens of centimeters, for example 30 to 50 centimeters, in the heightwise direction, so that here too the drying air or steam 23 moving through the duct 21 covers a significant distance in which it can output water to the duct walls. The chamber 21 is preferably formed by a flat duct. The duct 21 is further extended by the additional horizontal segment on the top wall 33 of the wash container 2, thereby providing more space for water to be able to condense. At least one wall of the duct 21 can optionally be formed by walls of the wash container 2. The further walls can be made of plastic or metal.

The intake opening (shown generally as 13) of the suction apparatus 28, which provides the chamber 21 with steam and/or air that has been taken in, is located, as described above, at the end of the wash container 2 facing the front face V and comprises a plurality of small, individual inlet windows 14 at a distance from one another in upright edge regions 15 and in an upper edge region 16 running in the transverse direction Q. In the diagram in FIG. 5 the intake opening 15 therefore generally extends in a U shape over two front lateral edges 15 of the wash container and the upper edge or transverse connection 16 of the wash container.

According to one advantageous variant of the invention however it may be sufficient in particular simply to provide several inlet windows distributed over the width of the wash container on the front upper top edge or a single inlet opening running over the width of the wash container. In any case one or several inlet windows can expediently also be provided in the upper region of the respective side wall.

This/these one or several inlet windows preferably penetrate(s) the top wall and/or the respective side wall of the wash container from its inside, in other words in the vertical direction. This is only shown schematically in the exemplary embodiment in FIG. 5. Other arrangements of the one or several inlet windows are of course also possible.

The inlet windows, e.g. 14 in FIG. 5, are advantageously preferably provided outside the wet chamber, e.g. 26, of the wash container, e.g. 2, in particular in a front edge zone, e.g. 15, 16, of the wash container that remains dry during the respective wash process in front of its loading opening, e.g. 27, which is delimited by a door seal, e.g. 30, of the wash container positioned there. This means that said inlet windows are only accessible for steam and/or air escaping from the wet chamber, e.g. 26, of the wash container, e.g. 2, when the door is open. This largely prevents liquid passing through the several inlet windows of the suction apparatus, e.g. 28, into its downstream components, e.g. its fan or suction blower, e.g. 18, during the wash operation of the dishwasher and causing damage there. Particular sealing measures or complex sprayed water protection measures are not required with this advantageous variant of the suction apparatus. The one or several inlet windows 14 are preferably configured as simple through openings, e.g. in the form of holes stamped in the edge region of the wash container projecting forward in relation to the door seal 30 in the exemplary embodiment in FIG. 5. This largely avoids complex reconstruction of the wash container. Also steam and/or air can be suctioned through the one or several inlet windows directly in the local region where said steam and/or air leave(s) the loading opening, before the steam and/or air can stream too far away from the loading opening of the wash container and reach the adjacent furniture or a user standing in front of the dishwasher in an impermissible manner.

In the exemplary embodiment in FIG. 5 the inlet windows 14 open outside the wash container 2 into an air intake duct, which preferably also has the shape of a U open at the bottom here and in which air moves to the intake unit, in particular to the intake blower 18, during the intake. Said intake blower 18 is located at the top on the top wall 33 of the wash container 2 and bundles the air moved in the air intake duct into the horizontal component of the duct-like chamber 21 described above. The air entering there is then conveyed into the vertical component of the chamber 21 and downward therein and can largely condense there. The duct-like chamber 21 runs down to at least one outlet opening 25. This can be aligned in the direction of the wash container 2. Alternatively or additionally it would also be possible to blow the largely dried air 23 to the outside. The air intake duct 21 is only shown schematically in three dimensions above the top wall 33 for the sake of simplicity in FIG. 5 and is omitted in the outer region of the side walls 34, 35, only the inlet windows 14 being shown there.

A collection region for liquid can be present in the lower region of the duct-like chamber 21, so that liquid can run back into the wash container 2, even if the air 23 is blown to the outside.

In this variant, in a critical time period of the respective wash program, when steam and/or moist air can exit through the door 3, the suction unit 18 can also be activated to suction said exiting steam and/or moist air.

Suctioning can only take place partially in critical regions. For the most efficient suctioning possible fresh air 24 can also be supplied specifically for example in the lower corner region. This can be taken in from the surroundings or a region in which the temperature has previously been set below the base. An additional blower may be possible for this purpose.

It is of course also possible to provide several ducts 20, 21 on a dishwasher 1. Their outer walls are able to be at least partially cooled for particularly efficient condensation.

The intake openings 12, 13 shown in the exemplary embodiments are not accessible for steam and/or moist air from the wet chamber or treatment chamber 26 of the wash container when the dishwasher 1 is operated with the door 3 closed so heating and soiling of the ducts 20, 21 is largely avoided. Wash liquor from the wash container 2 cannot enter there. There is only a direct connection to the wash container 2 when the door 3 is opened (slightly). Such door opening can take place automatically without user intervention during or in particular at the end of a drying program step.

The suction unit 17, 18 can be switched on here by opening the door 3 so that energy is only required when actual use is involved.

Suctioning the steam means that it can no longer condense on the furniture or small quantities of condensate dry up very quickly. The furniture is therefore protected from the condensate without additional protection such as films or sheets.

Generally speaking at least one suction apparatus is provided to suction or suck away steam and/or moisture-laden air, which would otherwise stream upward and/or forward out of the wash container from the region of the resulting opening gap between the front door and the wash container, in particular between the upper edge of the front door and the top element of the wash container, when the door is opened. The steam and/or moisture-laden air is/are sucked away from the door opening gap by means of the suction apparatus, in other words prevented from getting through it and escaping up and/or forward into the surroundings. The suction means allow the steam and/or moisture-laden air to be largely held back before exiting upward and/or forward from the wash container through the opening gap between the wash container and the door, when the door is opened to form a preferably narrow gap in relation to the wash container. The suction apparatus or suction means expediently comprise(s) one or several inlet windows for taking in steam and/or air, an air duct or air chamber connecting thereto and at least one intake blower or other intake means preferably housed in the air duct or air chamber.

In particular the respective suction apparatus can comprise one or several inlet openings, which are provided on the front opening edge of the wash container, in particular on the upper opening edge and/or at least in the upper segment of the two lateral opening edges of the wash container. They are preferably located outside the wet region of the wash container, in other words outside the inner chamber of the wash container, which is supplied with wash liquid when the door of the wash container is closed during the wash operation. The opening edge of the top wall and the two side walls of the wash container can preferably be reinforced on the outside by a reinforcing frame positioned on the front of the wash container. A door seal delimiting the loading opening of the wash container is preferably provided where the inside of the door comes into contact with the wash container walls in its closed position. The one or several suction openings is/are expediently provided in front of the door seal in the front edge region of the wash container. Before steam and/or moist, hot air can exit precipitously in an upward direction from the inner chamber of the wash container through the door gap, when the door is moved from its closed position to an open position to form an opening gap, it is sucked away or deflected away by means of suction means. This largely prevents steam and/or moist, hot air passing along kitchen furniture that is colder than the wash container inner chamber and condensing there.

The invention claimed is:

1. A domestic dishwasher, comprising:

a wash container having a loading opening, a door configured to close the wash container; and a suction apparatus configured to suck off steam and/or air escaping from the loading opening, wherein the suction apparatus has one or several inlet windows at least in an upper region of the wash container or the door, and wherein the one or several inlet windows is/are only accessible for intake of steam and/or air escaping from a wet chamber of the wash container when the door is opened, such that the one or several inlet windows is/are not accessible to a washing water, stream, and/or air that is inside of the wash container when the door is closed.

2. The domestic dishwasher of claim 1, wherein the air is laden with moisture.

3. The domestic dishwasher of claim 1, wherein the one or several inlet windows is/are located in a front edge zone of the wash container, said front edge zone remaining dry during a wash process and positioned in front of the loading opening.

4. The domestic dishwasher of claim 1, wherein the one or several inlet windows is/are located in front of a door seal of the wash container, said door seal delimiting the loading opening.

5. The domestic dishwasher of claim 1, wherein the one or several inlet windows is/are located in a top wall, in a left side wall and/or in a right side wall of the wash container, said one or several inlet windows being accessible only from an inside of the wash container when the door is opened for steam and/or air to escape from the wet chamber of the wash container.

6. The domestic dishwasher of claim 1, wherein the suction apparatus is switched on as the door opens or shortly before the door opens.

7. The domestic dishwasher of claim 1, wherein the suction apparatus is switched on at the latest as soon as the door is opened and moved from a closed position to an open position in which an opening gap opens up between the door and the wash container.

8. The domestic dishwasher of claim 7, further comprising an automatic door opening mechanism to move the door from the closed position to the open position.

9. The domestic dishwasher of claim 7, wherein the opening gap has a depthwise extension of between 2 cm and 20 cm when viewed in a depthwise direction of the wash container.

10. The domestic dishwasher of claim 1, further comprising a monitoring facility configured to switch on the suction apparatus when a temperature in the wet chamber of the wash container exceeds a predefined threshold temperature beyond which steam is generated in the wet chamber of the wash container and a presence of or start of an opening of the door is detected.

11. The domestic dishwasher of claim 10, wherein the predefined threshold temperature is around 40° C.

12. A domestic dishwasher, comprising:

a wash container configured for cleaning dishes, glasses, flatware or similar items, said wash container having an intake opening for intake of air present in the wash container, said intake opening transitioning into a chamber of the dishwasher for condensing moisture in air taken in, a suction unit downstream of the intake opening, and a door configured to close the wash container and displaceable to open the wash container, wherein the wash container has a wet chamber, said intake opening being only accessible for air and/or steam exiting from the wet chamber of the wash container when the door is open, wherein the intake opening comprises a plurality of inlet windows located outside the wet chamber of the wash container, and wherein the inlet windows are arranged in a pattern located in a top wall, in a left side wall, and in a right side wall in a front edge zone of the wash container.

13. The domestic dishwasher of claim 12, wherein the suction unit is configured to be switched on by a preset automated step in a program sequence or by opening the door.

14. The domestic dishwasher of claim 12, wherein the chamber is configured in the form of a duct.

15. The domestic dishwasher of claim 12, wherein the chamber is located outside the wash container in the dishwasher.

16. The domestic dishwasher of claim 12, wherein the chamber substantially runs downward from the intake opening to an outlet opening.

17. The domestic dishwasher of claim 12, wherein the chamber has a lower end provided with a collection region or a return for a liquid.

18. The domestic dishwasher of claim 12, wherein the chamber has an outlet opening in a direction of the wash container.

19. The domestic dishwasher of claim 12, wherein the chamber has an outlet opening in a direction outside the domestic dishwasher.

20. The domestic dishwasher of claim 12, wherein the pattern of inlet windows has an overall width of at least 40 centimeters, when the dishwasher has a total width of 45 centimeters.

21. The domestic dishwasher of claim 12, wherein the pattern of inlet windows has an overall width of at least 55 centimeters, when the dishwasher has a total width of 60 centimeters.

22. The domestic dishwasher of claim 12, wherein the chamber has outer walls configured to be cooled for condensing.

23. A method for operating a domestic dishwasher, comprising:

operating the dishwasher in a sub-program step for drying an item being washed in a wash container closed by a door, slightly opening the door for drying the item to enable steam and/or air that has been taken in via an intake opening to exit from a loading opening of the wash container via an air gap formed as the door is opened, and suctioning the steam and/or air by a suction unit downstream of the intake opening.

24. The method of claim 23, wherein the door is opened at the end of the sub-program.

25. The method of claim 23, further comprising diverting or deflecting the steam and/or air exiting from the loading opening by the suction unit in a direction away from an outflow path steeply leading upward through the air gap, and guiding the exiting steam and/or air to the intake opening.

26. The method of claim 25, wherein the steam and/or the air exiting from the loading opening is moved horizontally away from the air gap by the suction unit.

27. The method of claim 23, further comprising placing the intake opening in opposition to the door, wherein the air gap via which steam and/or air exits from the loading opening is up to 20 centimeters between the wash container and the intake opening.

28. The method of claim 23, further comprising automatically opening the door at the end of the drying step, and switching on the suction unit at a same time or shortly before.

29. The method of claim 23, further comprising automatically opening the door after the drying step has been completed, and switching on the suction unit at a same time or shortly before.

30. A domestic dishwasher, comprising: a wash container having a loading opening, a door configured to close the wash container; and a suction apparatus configured to suction steam and/or air escaping from the loading opening when the door is opened, wherein the suction apparatus comprises a slot-shaped opening disposed in an inner face of the door and extending over at least a portion of a width of the door in an upper region of the door.

31. The domestic dishwasher of claim 30, wherein the slot-shaped opening extends over a full width of the door.

32. A domestic dishwasher, comprising:

a wash container having a loading opening, a door configured to close the wash container; and a suction apparatus configured to suction steam and/or air escaping from the loading opening, wherein the suction apparatus comprises a plurality of inlet windows located outside a wet chamber of the wash container, wherein the inlet windows are located in a top wall, in a left side wall, and in a right side wall in a front edge zone of the wash container, and wherein the inlet windows are only accessible for intakes of steam and/or air escaping from a wet chamber of the wash container when the door is opened.

* * * * *